US008419381B2

(12) United States Patent
Ito et al.

(10) Patent No.: US 8,419,381 B2
(45) Date of Patent: Apr. 16, 2013

(54) TANDEM PISTON PUMP

(75) Inventors: Kazumi Ito, Sagamihara (JP); Atsushi Aoyama, Sagamihara (JP)

(73) Assignee: Kayaba Industry Co., Ltd., Tokyo (JP)

( * ) Notice: Subject to any disclaimer, the term of this patent is extended or adjusted under 35 U.S.C. 154(b) by 337 days.

(21) Appl. No.: 12/452,946

(22) PCT Filed: Jul. 31, 2007

(86) PCT No.: PCT/JP2007/065325

§ 371 (c)(1),
(2), (4) Date: Jan. 29, 2010

(87) PCT Pub. No.: WO2009/016768

PCT Pub. Date: Feb. 5, 2009

(65) Prior Publication Data

US 2010/0135827 A1 Jun. 3, 2010

(51) Int. Cl.
*F04B 1/12* (2006.01)
*F04B 27/08* (2006.01)

(52) U.S. Cl.
USPC ..... 417/269; 417/216; 91/499

(58) Field of Classification Search ..... 417/203, 417/216, 222.1, 244, 254, 269; 92/57; 91/499
See application file for complete search history.

(56) References Cited

U.S. PATENT DOCUMENTS

| | | | | | |
|---|---|---|---|---|---|
| 2,391,575 | A | * | 12/1945 | Huber | 91/490 |
| 2,570,843 | A | * | 10/1951 | Orshansky, Jr. | 92/12.2 |
| 2,690,133 | A | * | 9/1954 | Dodge | 417/269 |
| 2,844,002 | A | * | 7/1958 | Pavesi | 91/480 |
| 2,923,251 | A | * | 2/1960 | De Laney | 91/480 |
| 3,093,081 | A | * | 6/1963 | Budzich | 417/216 |
| 3,975,990 | A | * | 8/1976 | Kraus | 91/499 |
| 6,361,282 | B1 | * | 3/2002 | Wanschura | 417/269 |

FOREIGN PATENT DOCUMENTS

| | | |
|---|---|---|
| JP | 3-264778 A | 11/1991 |
| JP | 8-177732 A | 7/1996 |

* cited by examiner

*Primary Examiner* — Peter J Bertheaud
(74) *Attorney, Agent, or Firm* — Rabin & Berdo, P.C.

(57) ABSTRACT

In a tandem piston pump (1) from which pump discharge pressure from four systems is extracted, a tilt axis direction of a front swash plate (14) and a tilt axis direction of a rear swash plate (54) are different to each other, respective discharge ports (23, 24) of a rear pump (50) are opened at a phase difference relative to respective discharge ports (21, 22) of a front pump (10), and respective pump ports (41, 42) of the front pump (10) and respective pump ports (43, 44) of the rear pump (50) are opened in different side faces (71, 72) of a port block (70).

2 Claims, 4 Drawing Sheets

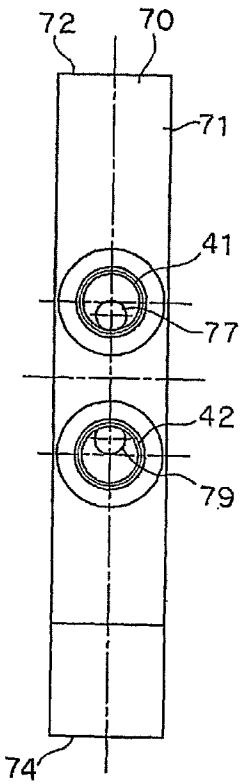
FIG. 4C
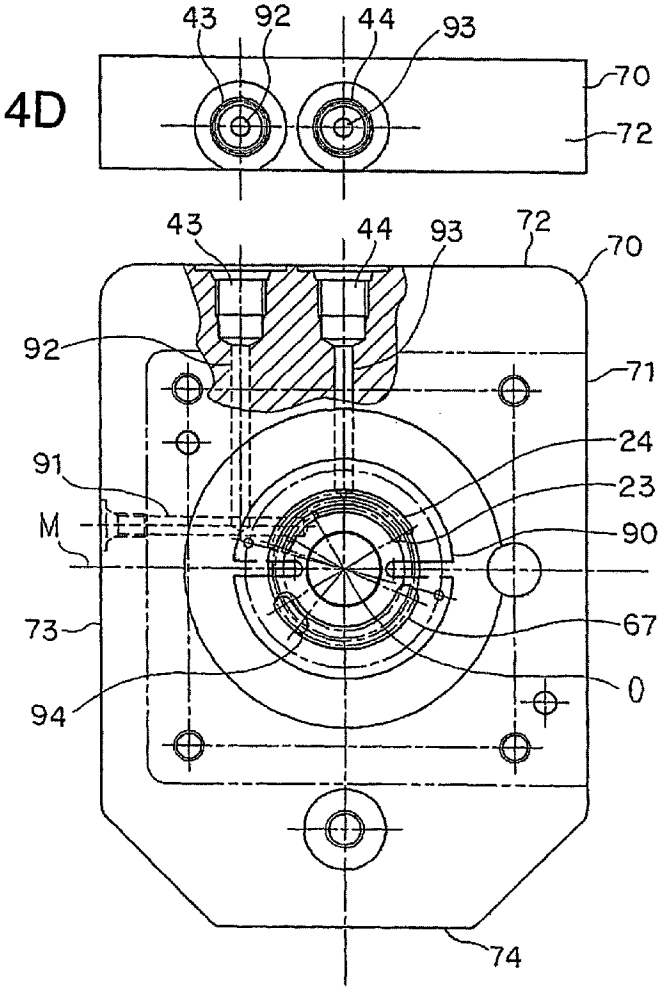
FIG. 4D
FIG. 4A
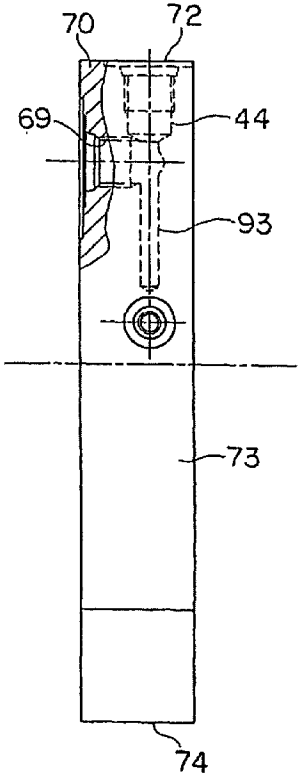
FIG. 4B

TANDEM PISTON PUMP

TECHNICAL FIELD

A front pump and a rear pump are respectively constituted by one-flow type swash plate piston pumps such that pump discharge pressure is extracted from two systems.

BACKGROUND ART

In a conventional tandem piston pump disclosed in JPH08-177732A, a front pump and a rear pump are respectively constituted by one-flow type swash plate piston pumps such that pump discharge pressure is extracted from two systems.

In this tandem piston pump, a pump port through which working oil discharged from the front pump passes and a pump port through which working oil discharged from the rear pump passes are formed in a common port block.

In contrast, JPH03-264778A discloses a two-flow type swash plate piston pump in which pump discharge pressure from two systems is extracted from a single pump.

DISCLOSURE OF THE INVENTION

When a front pump and a rear pump of a tandem piston pump are respectively constituted by two-flow type swash plate piston pumps such that pump discharge pressure from four or more systems is extracted from a single tandem piston pump, four or more pump ports must be formed in the port block, and the space required to form the respective pump ports leads to an increase in the dimensions of the port block, causing an increase in the size of the apparatus.

It is therefore an object of this invention is to reduce the size of a tandem piston pump from which pump discharge pressure from four or more systems is extracted.

This invention provides a tandem piston pump from which pump discharge pressure from a plurality of systems is extracted, comprising: a shaft that rotates about a rotary axis; a front pump and a rear pump provided in series in a rotary axis direction; and a port block provided between the front pump and the rear pump, wherein the front pump comprises: a front cylinder block that is rotated by the shaft; a front swash plate that causes a plurality of pistons to reciprocate when the front cylinder block rotates; a plurality of discharge ports through which working oil discharged by the respective pistons passes; and a plurality of pump ports that communicate with the respective discharge ports to extract pump discharge pressure therefrom, the rear pump comprises: a rear cylinder block that is rotated by the shaft; a rear swash plate that causes a plurality of pistons to reciprocate when the rear cylinder block rotates; a plurality of discharge ports through which working oil discharged by the respective pistons passes; and a plurality of pump ports that communicate with the respective discharge ports to extract pump discharge pressure therefrom, a tilt axis direction of the front swash plate and a tilt axis direction of the rear swash plate are different to each other, the respective discharge ports of the rear pump are opened at a phase difference relative to the respective discharge ports of the front pump, and the respective pump ports of the front pump and the rear pump are opened in different side faces of the port block.

According to this invention, the respective pump ports of the front pump and the respective pump ports of the rear pump open onto different side faces of the port block, and therefore a situation in which a plurality of pump ports are opened in concentrated fashion in a single side face can be avoided, leading to a reduction in a rotary axis direction dimension of the port block and a corresponding reduction in the size of the tandem piston pump.

BRIEF DESCRIPTION OF THE DRAWINGS

FIGS. 4A-4D are four orthogonal views of the port block.

BEST MODES FOR CARRYING OUT THE INVENTION

An embodiment of this invention will be described below with reference to the drawings.

A tandem piston pump 1 shown in FIGS. 1 to 4 is installed in a construction machine such as a mini shovel, for example, as an oil pressure source.

Figure 1:
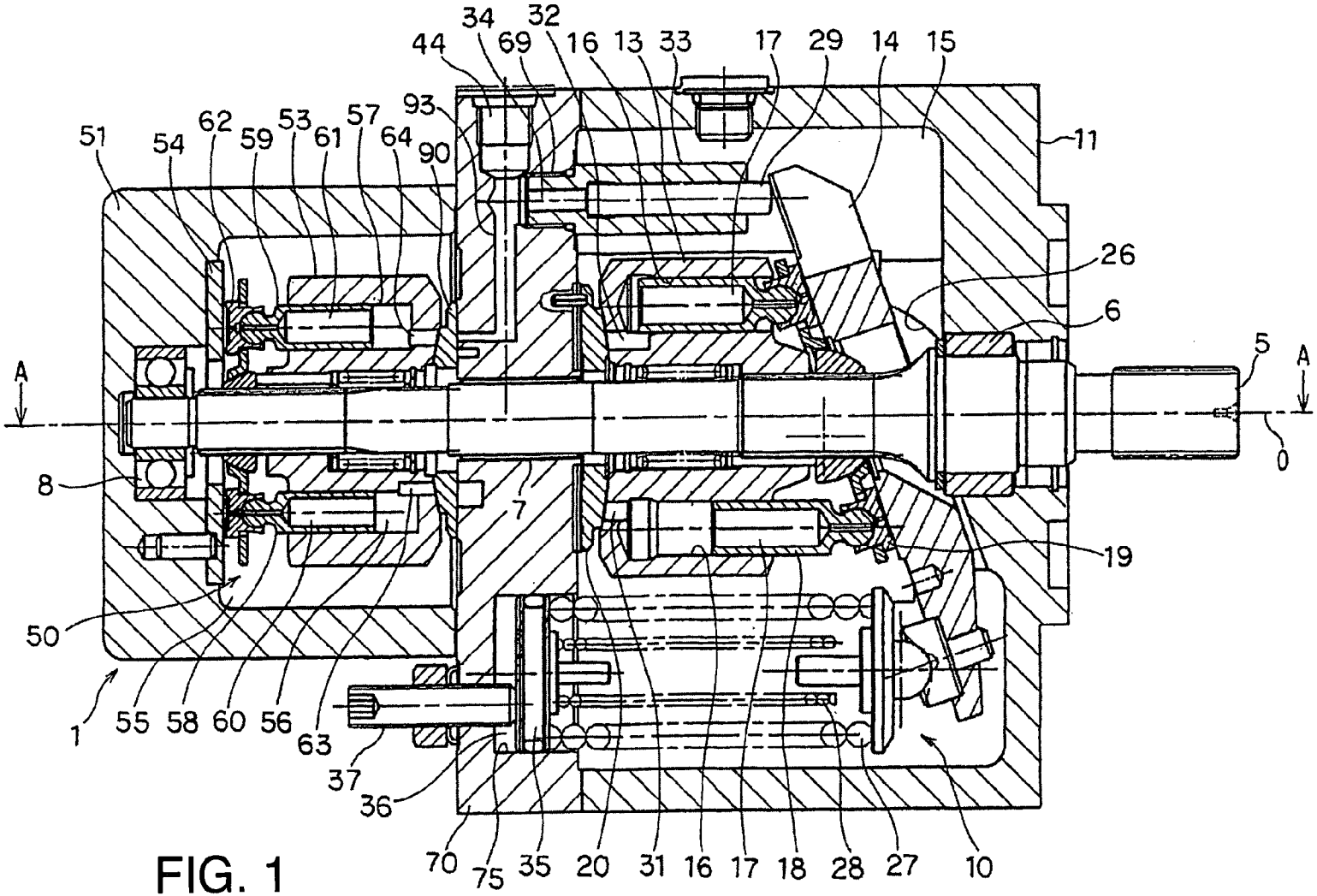
FIG. 1 is a sectional view of a tandem piston pump according to an embodiment of this invention.
Figure 2:
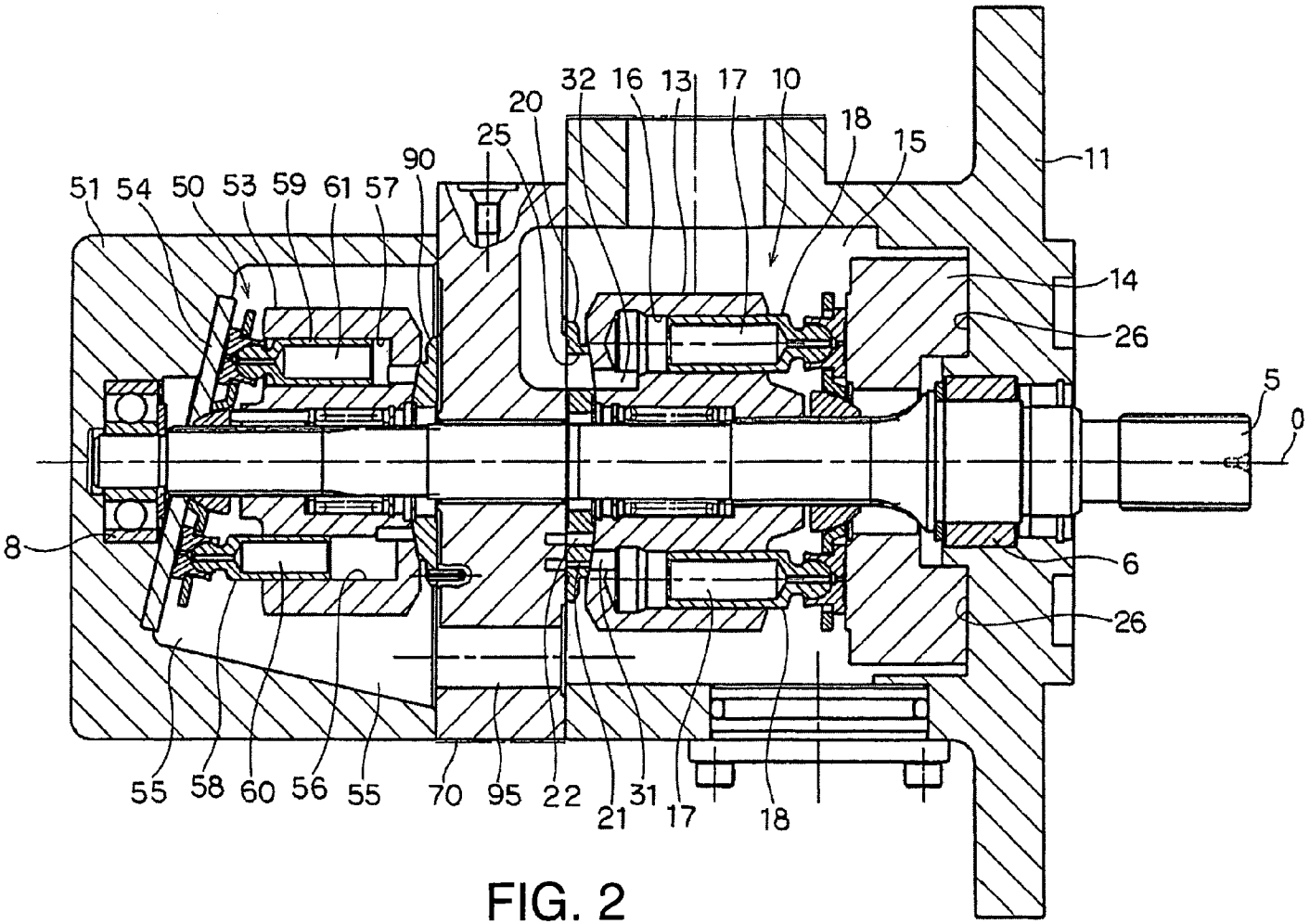
FIG. 2 is a sectional view taken along an A-A line in FIG. 1.

FIG. 1 is a sectional view showing a rotary axis O of the tandem piston pump 1, and FIG. 2 is a sectional view taken along an A-A line in FIG. 1.

As shown in FIGS. 1 and 2, in the tandem piston pump 1, a front pump 10 and a rear pump 50 are provided in series in a direction of a rotary axis O.

A common shaft 5 is provided between the front pump 10 and the rear pump 50. The shaft 5 rotates about the rotary axis O when rotation of an engine provided as a power source, not shown in the figures, is transmitted to a base end portion thereof.

The tandem piston pump 1 comprises, as an interconnected housing, a front pump housing 11 housing the front pump 10, a port block 70, and a rear pump housing 51 housing the rear pump 50. The port block 70 is disposed between the front pump housing 11 and the rear pump housing 51.

The shaft 5 is supported to be capable of rotating relative to the front pump housing 11, port block 70, and rear pump housing 51 via three bearings 6, 7, 8. The base end portion of the shaft 5 projects outward from the front pump housing 11 such that the rotation of the engine, not shown in the figures, is transmitted thereto.

The front pump 10 is accommodated between the front pump housing 11 and the port block 70. The rear pump 50 is accommodated between the rear pump housing 51 and the port block 70.

It should be noted that this invention is not limited to a structure in which the port block 70 is formed separately to the front pump housing 11 and rear pump housing 51, and the port block 70 may be formed integrally with the front pump housing 11 and rear pump housing 51.

The front pump 10 and rear pump 50 are respectively constituted by two-flow type swash plate hydraulic pumps in which pump discharge pressure is extracted from two systems, and therefore pump discharge pressure from a total of four systems is extracted from the single tandem piston pump 1.

Figure 3:
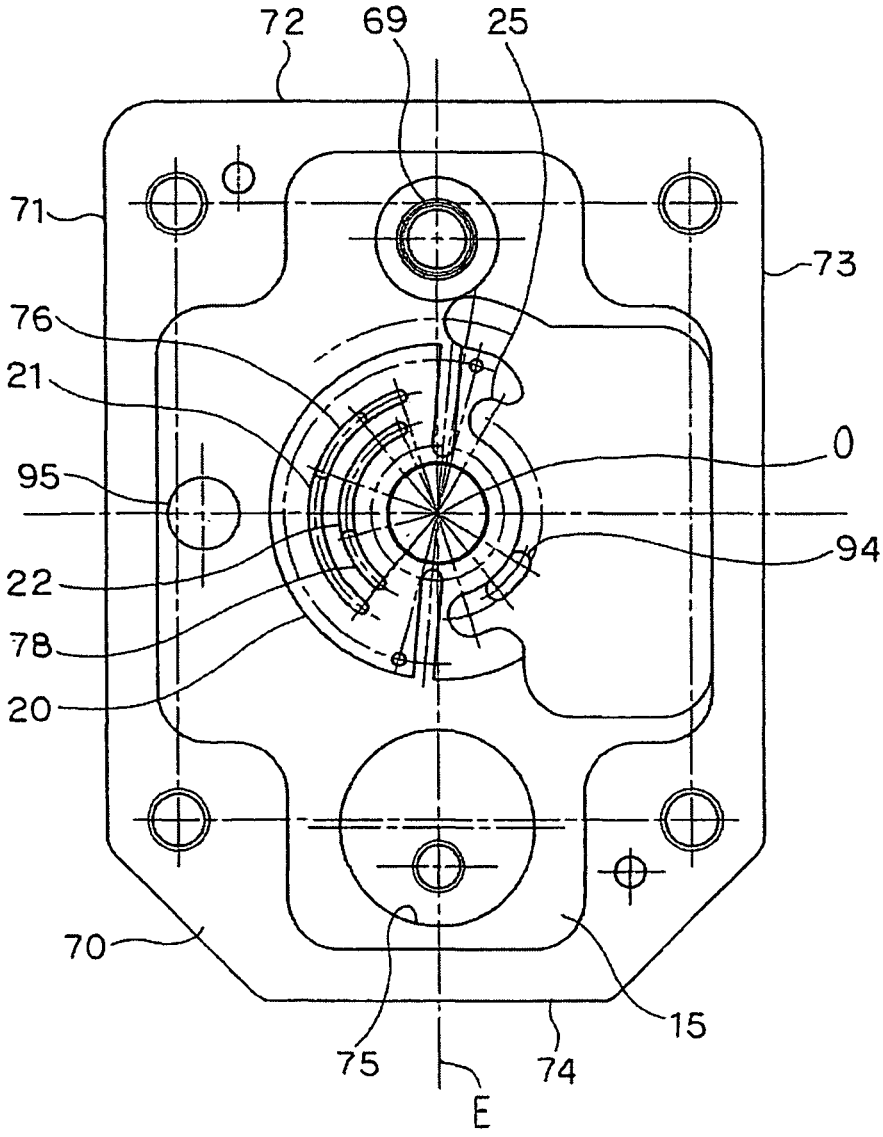
FIG. 3 is a front view showing a port block from the right side of FIG. 1.

FIG. 3 is a front view showing the port block 70 from the right side (the front pump 10 side) of FIG. 1. The port block 70 is formed in a block shape having four side faces 71 to 74.

FIG. 4A is a front view showing the port block 70 from the left side (the rear pump 50 side) of FIG. 1, FIG. 4B is a side view showing the port block 70 from the front side of FIG. 1, FIG. 4C is a side view showing the port block 70 from the rear side of FIG. 1, and FIG. 4D is a side view showing the port block 70 from the upper side of FIG. 1.

A first pump port 41 and a second pump port 42 from which working oil discharged from the front pump 10 is extracted are respectively opened in one side face 71 of the port block 70, while a third pump port 43 and a fourth pump port 44 from which working oil discharged from the rear pump 50 is extracted are respectively opened in another side face 72 of the port block 70.

The constitution of the front pump 10 will be described below using FIG. 1.

A front pump housing chamber 15 is defined by the front pump housing 11 and the port block 70, and a front cylinder block 13 and a front swash plate 14 are housed in the front pump housing chamber 15.

The front cylinder block 13 is attached and fitted to the shaft 5 and driven to rotate via the shaft 5.

A plurality of cylinders 16 are formed in circumferential direction series in the front cylinder block 13 such that a cylinder 16 which communicates with the first pump port 41 and a cylinder 16 which communicates with the second pump port 42 are arranged alternately.

The cylinders 16 are disposed parallel to the rotary axis O of the shaft 5, arranged at fixed intervals on an identical circumference centering on the rotary axis O, and formed with equal opening diameters.

It should be noted that the invention is not limited to this structure, and the cylinder 16 that communicates with the first pump port 41 may be formed with a different opening diameter to the cylinder 16 that communicates with the second pump port 42. Further, the cylinder 16 that communicates with the first pump port 41 and the cylinder 16 that communicates with the second pump port 42 may be disposed on different circumferences centering on the rotary axis O.

A piston 18 is inserted slidably into each cylinder 16, and a volume chamber 17 is defined between the cylinder 16 and the piston 18.

One end side of each piston 18 projects from the front cylinder block 13 and is supported via a shoe 19 that contacts the front swash plate 14.

When the front cylinder block 13 rotates, each piston 18 reciprocates relative to the front swash plate 14, thereby causing the volume chamber 17 of each cylinder 16 to expand and contract.

The front pump 10 is a variable volume pump in which a discharge amount can be varied, and the front swash plate 14 is supported tiltably on the front pump housing 11 via a pair of bearings 26.

Tilt springs 27, 28 that bias the front swash plate 14 in a direction for increasing a tilt angle are respectively interposed in the front pump housing 11.

A plunger 29 that drives the front swash plate 14 in a direction for decreasing the tilt angle against the tilt springs 27, 28 is provided as a tilt actuator that varies the tilt angle of the front swash plate 14.

The plunger 29 is supported to be capable of sliding substantially parallel to the rotary axis O via a guide sleeve 33. A screw hole 69 is formed in the port block 70, and the guide sleeve 33 is screwed fixedly into the screw hole 69.

A tip end of the plunger 29 contacts an extension portion of the front swash plate 14. A pressure chamber 34 is formed on a base end side of the plunger 29.

Discharge pressure from the rear pump 50 is led to the fourth pump port 44 and then introduced into the pressure chamber 34. As the pressure introduced into the pressure chamber 34 rises, the plunger 29 moves rightward in FIG. 1, and as a result, the front swash plate 14 rotates in a direction for reducing the tilt angle against the respective tilt springs 27, 28.

One end of each of the tilt springs 27, 28 is received by a disc-shaped large-diameter plunger 35. A cylinder 75 is formed in the port block 70, and the large-diameter plunger 35 is inserted slidably into the cylinder 75. A pressure chamber 36 is formed between the cylinder 75 and the large-diameter plunger 35. As the pressure introduced into the pressure chamber 36 rises, the large-diameter plunger 35 moves rightward in FIG. 1, and as a result, a compressive load of the tilt springs 27, 28 biasing the front swash plate 14 increases.

An adjuster rod 37 is provided in contact with the large-diameter plunger 35 to adjust an initial position of the large-diameter plunger 35.

Cylinder ports 31, 32 that communicate respectively with the cylinders 16 are opened in an end face of the front cylinder block 13. The cylinder ports 31, 32 are disposed alternately for each adjacent cylinder 16 on different radii centering on the rotary axis O.

As shown in FIG. 3, a port plate 20 joined to the port block 70 is provided, and the end face of the front cylinder block 13 contacts the port plate 20 slidingly.

In the two-flow type front pump 10, an intake port 25, a first discharge port 21, and a second discharge port 22 that communicate with the respective volume chambers 17 are opened in the port plate 20 in arc shapes respectively centering on the rotary axis O, and independent pump discharge pressures are generated in the first discharge port 21 and the second discharge port 22.

The intake port 25 extends in an arc shape along respective rotation paths of the cylinder port 31 and the cylinder port 32 so as to communicate with the cylinder port 31 and the cylinder port 32 in a predetermined rotation angle range.

The intake port 25 opens onto the front pump housing chamber 15 such that working oil circulating via an intake pipe, not shown in the figures, is led from the front pump housing chamber 15 to the cylinder port 31 and cylinder port 32 through the intake port 25.

The first discharge port 21 extends in an arc shape around the rotation path of the cylinder port 31 so as to communicate with the cylinder port 31 in a predetermined rotation angle range.

The second discharge port 22 extends in an arc shape around the rotation path of the cylinder port 32 so as to communicate with the cylinder port 32 in a predetermined rotation angle range.

The first discharge port 21 and second discharge port 22 open in an identical angle range centering on the rotary axis O, and the first discharge port 21 is positioned further toward a radial direction outer side than the second discharge port 22.

As shown in FIG. 3, a port 76 that opens onto the first discharge port 21 of the port plate 20 is formed in the port block 70.

As shown in FIG. 4C, a port 77 that opens onto the first pump port 41 is formed in the port block 70.

The first discharge port 21 communicates with the first pump port 41 via the port 76 and the port 77.

Working oil discharged from the first discharge port 21 is led to the first pump port 41 through the port 76 and the port 77 formed in the port block 70. A hydraulic pipe, not shown in the figures, is connected to the first pump port 41.

As shown in FIG. 3, a port 78 that communicates with the second discharge port 22 of the port plate 20 is formed in the port block 70.

As shown in FIG. 4C, a port 79 that communicates with the second pump port 42 is formed in the port block 70.

The second discharge port 22 communicates with the second pump port 42 via the port 78 and the port 79.

Working oil discharged from the second discharge port 22 is led to the second pump port 42 through the port 78 and the port 79 formed in the port block 70. A hydraulic pipe, not shown in the figures, is connected to the second pump port 42.

An operation of the front pump 10 will now be described.

When the front cylinder block 13 rotates via the shaft 5, the pistons 18 reciprocate within the respective cylinders 16 by a stroke corresponding to the tilt angle of the front swash plate 14.

During an intake stroke in which the volume chamber 17 of the cylinder 16 is caused to expand by the piston 18, working oil is suctioned into the respective volume chambers 17 from the intake port 25 through the cylinder port 31 or the cylinder port 32.

During a discharge stroke in which the volume chamber 17 of the cylinder 16 is caused to contract by the piston 18, on, the other hand, working oil discharged to the first discharge port 21 from the respective volume chambers 17 through the cylinder port 31 is led to the first pump port 41 through the port 76 and the port 77 and then supplied to a hydraulic machine from the first pump port 41 via the hydraulic pipe, not shown in the figures, while working oil discharged to the second discharge port 22 from the respective volume chambers 17 through the cylinder port 32 is led to the second pump port 42 through the port 78 and the port 79 and then supplied to a hydraulic machine from the second pump port 42 via the hydraulic pipe, not shown in the figures.

Thus, pump discharge pressure from two systems is extracted from the front pump 10.

It should be noted that this invention is not limited to a structure in which the front pump 10 is a two-flow type pump from which pump discharge pressure from two systems is extracted, and the front pump 10 may be a pump from which pump discharge pressure from three or more systems is extracted.

The constitution of the rear pump 50 will now be described.

As shown in FIGS. 1 and 2, a rear pump housing chamber 55 is defined by the rear pump housing 51 and the port block 70, and a rear cylinder block 53 and a rear swash plate 54 are housed in the rear pump housing chamber 55.

The rear cylinder block 53 is attached and fitted to the shaft 5 and driven to rotate via the shaft 5.

A plurality of cylinders 56, 57 are formed alternately in series in the rear cylinder block 53. Each cylinder 56 communicates with the third pump port 43 and each cylinder 57 communicates with the fourth pump port 44.

The cylinders 56, 57 are disposed parallel to the rotary axis O of the shaft 5 and arranged at fixed intervals on an identical circumference centering on the rotary axis O. The opening diameter of the cylinder 56 is set to be smaller than the opening diameter of the cylinder 57.

It should be noted that the invention is not limited to this structure, and the cylinder 56 that communicates with the third pump port 43 may be formed with an identical opening diameter to the cylinder 57 that communicates with the fourth pump port 44. Further, the cylinders 56 and the cylinders 57 may be disposed on different circumferences centering on the rotary axis O.

Pistons 58, 59 are inserted slidably into the respective cylinders 56, 57, and volume chambers 60, 61 are formed respectively between the cylinders 56, 57 and the pistons 58, 59.

One end side of each piston 58, 59 projects from the rear cylinder block 53 and is supported via a shoe 62 that contacts the rear swash plate 54.

When the rear cylinder block 53 rotates, each piston 58, 59 reciprocates by a stroke corresponding to the tilt angle of the rear swash plate 54, thereby causing the respective volume chambers 60, 61 to expand and contract.

The rear pump 50 is a fixed volume type pump, and therefore the rear swash plate 54 is fixed to the rear pump housing 51. The rear swash plate 54 is tilted by a predetermined angle relative to the rotary axis O of the shaft 5.

Note that the invention is not limited to this structure, and the rear swash plate 54 may be supported tiltably by the rear pump housing 51 and tilted via an actuator such that the discharge amount of the rear pump 50 is made variable.

Cylinder ports 63, 64 that communicate with the respective volume chambers 60, 61 are opened in an end face of the rear cylinder block 53. The cylinder ports 63, 64 are disposed alternately for each cylinder 56, 57 on different radii centering on the rotary axis O.

As shown in FIG. 4A, a port plate 90 joined to the port block 70 is provided, and the end face of the rear cylinder block 53 contacts the port plate 90 slidably.

In the two-flow type rear pump 50, an intake port 67, a third discharge port 23, and a fourth discharge port 24 that communicate with the respective volume chambers 60, 61 are opened in the port plate 90 in arc shapes respectively centering on the rotary axis O, and independent pump discharge pressures are generated in the third discharge port 23 and the fourth discharge port 24.

The intake port 67 extends in an arc shape along respective rotation paths of the cylinder ports 63, 64 so as to communicate with the cylinder port 63 and the cylinder port 64 in a predetermined rotation angle range.

As shown in FIG. 4A, a port 94 that communicates with the intake port 67 and the intake port 25 is formed in the port block 70. The intake port 67 opens onto the rear pump housing chamber 55 such that working oil circulating via an intake pipe, not shown in the figures, is led from the rear pump housing chamber 55 to the cylinder ports 63, 64 through the intake port 67.

As shown in FIG. 2, a port 95 is formed in the port block 70, and the front pump housing chamber 15 communicates with the rear pump housing chamber 55 via this port 95.

The third discharge port 23 extends in an arc shape around the rotation path of the cylinder port 63 so as to communicate with the cylinder port 63 in a predetermined rotation angle range.

The fourth discharge port 24 extends in an arc shape around the rotation path of the cylinder port 64 so as to communicate with the cylinder port 64 in a predetermined rotation angle range.

The third discharge port 23 and fourth discharge port 24 open in an identical angle range centering on the rotary axis O, and the third discharge port 23 is positioned further toward a radial direction inner side than the fourth discharge port 24.

As shown in FIG. 4A, a port 91 that communicates with the third discharge port 23 of the port plate 90 is formed in the port block 70. As shown in FIG. 4D, a port 92 that communicates with the third pump port 43 is formed in the port block 70. The third discharge port 23 communicates with the third pump port 43 via the port 91 and the port 92.

Working oil discharged from the third discharge port 23 is led to the third pump port 43 through the port 91 and the port 92 formed in the port block 70. A hydraulic pipe, not shown in the figures, is connected to the third pump port 43.

As shown in FIGS. 4A and 4D, a port 93 that communicates with the fourth discharge port 24 and the fourth pump port 44 is formed in the port block 70.

Working oil discharged from the fourth discharge port 24 is led to the fourth pump port 44 through the port 93 formed in the port block 70. A hydraulic pipe, not shown in the figures, is connected to the fourth pump port 44.

An operation of the rear pump 50 will now be described.

When the rear cylinder block 53 rotates via the shaft 5, the pistons 58, 59 reciprocate within the respective cylinders 56, 57.

During an intake stroke in which the respective volume chambers 60, 61 of the cylinders 56, 57 are caused to expand by the pistons 58, 59, working oil is suctioned into the respective volume chambers 60, 61 from the intake port 67 through the cylinder ports 63, 64.

During a discharge stroke in which the respective volume chambers 60, 61 of the cylinder 56, 57 are caused to contract by the pistons 58, 59, on the other hand, working oil discharged to the third discharge port 23 from the respective volume chambers 60 through the cylinder port 63 is led to the third pump port 43 through the port 91 and the port 92 and then supplied to a hydraulic machine from the third pump port 43 via the hydraulic pipe, not shown in the figures, while working oil discharged to the fourth discharge port 24 from the respective volume chambers 61 through the cylinder port 64 is led to the fourth pump port 44 through the port 93 and then supplied to a hydraulic machine from the fourth pump port 44 via the hydraulic pipe, not shown in the figures.

Thus, pump discharge pressure from two systems is extracted from the rear pump 50.

It should be noted that this invention is not limited to a structure in which the rear pump 50 is a two-flow type pump from which pump discharge pressure from two systems is extracted, and the rear pump 50 may be a pump from which pump discharge pressure from three or more systems is extracted.

Incidentally, the front pump 10 is a variable volume pump in which the tilt angle of the front swash plate 14 varies when the front swash plate 14 rotates about a tilt axis, leading to variation in the discharge flow (pump displacement volume) thereof.

The tilt axis of the front swash plate 14 is set to extend in a horizontal direction orthogonal to the rotary axis O. The tilt axis of the front swash plate 14 extends in an orthogonal direction to the paper surface of FIG. 1.

In FIG. 3, a front pump center line E separates a region in which the front pump 10 discharges working oil from a region in which the front pump 10 suctions working oil. Each piston 18 reaches a top dead center and a bottom dead center, at which a sliding direction of the piston 18 within the cylinder 16 switches, on the front pump center line E.

The front pump center line E is orthogonal to the rotary axis O and orthogonal to the tilt axis of the front swash plate 14.

The rear pump 50 is a fixed volume pump in which the rear swash plate 54 is fixed at a predetermined tilt angle centering on a tilt axis such that the discharge flow thereof does not vary.

The tilt axis of the rear swash plate 54 is set to extend in a vertical direction orthogonal to the rotary axis O. The tilt axis of the rear swash plate 54 extends in a vertical direction relative to the paper surface of FIG. 2.

In FIG. 4A, a rear pump center line M separates a region in which the rear pump 50 discharges working oil from a region in which the rear pump 50 suctions working oil. Each piston 58 reaches a top dead center and a bottom dead center, at which a sliding direction of the piston 58 within the cylinder 56 switches, on the rear pump center line M.

The rear pump center line M is orthogonal to the rotary axis O and orthogonal to the tilt axis of the rear swash plate 54.

Hence, the tandem piston pump 1 is constituted such that a tilt axis direction of the front swash plate 14 and a tilt axis direction of the rear swash plate 54 differ from each other by substantially 90°.

By constituting the tandem piston pump 1 such that the tilt axis direction of the front swash plate 14 and the tilt axis direction of the rear swash plate 54 differ from each other by substantially 90°, the front pump center line E and the rear pump center line M intersect at substantially 90°. Therefore, a phase difference of substantially 90° exists between the rotation angle range of the shaft 5 in which the front pump 10 discharges working oil and the rotation angle range of the shaft 5 in which the rear pump 50 discharges working oil.

By providing a phase difference of substantially 90° between the rotation angle range of the shaft 5 in which the front pump 10 discharges working oil and the rotation angle range of the shaft 5 in which the rear pump 50 discharges working oil, the third discharge port 23 and fourth discharge port 24 of the rear pump 50 open at a phase difference of substantially 90° relative to the first discharge port 21 and second discharge port 22 of the front pump 10.

Hence, the third pump port 43 and fourth pump port 44 that communicate with the third discharge port 23 and fourth discharge port 24 of the rear pump 50 can be disposed at a phase difference of substantially 90° on the rotary axis O relative to the first pump port 41 and second pump port 42 that communicate with the first discharge port 21 and second discharge port 22 of the front pump 10.

The port block 70 includes the mutually orthogonal side faces 71 and 72, the first pump port 41 and second pump port 42 opening onto the side face 71 and the third pump port 43 and fourth pump port 44 opening onto the side face 72.

The side face 71 is positioned on a side (the left side of the front pump center line E in FIG. 3) on which the front pump 10 discharges working oil. Therefore, by opening the first pump port 41 and second pump port 42 through which the working oil discharged from the front pump 10 passes in the side face 71, a passage length of the ports 76, 77 connecting the first discharge port 21 and the first pump port 41 can be shortened and a passage length of the ports 78, 79 connecting the second discharge port 22 and the second pump port 43 can be shortened.

The side face 72 is positioned on a side (the upper side of the rear pump center line M in FIG. 4A) on which the rear pump 50 discharges working oil. Therefore, by opening the third pump port 43 and fourth pump port 44 through which the working oil discharged from the rear pump 50 passes in the side face 72, a passage length of the ports 91, 92 connecting the third discharge port 23 and the third pump port 43 can be shortened and a passage length of the port 93 connecting the fourth discharge port 24 and the fourth pump port 44 can be shortened.

By opening the first pump port 41 and second pump port 42 in the side face 71 and opening the third pump port 43 and fourth pump port 44 in the side face 72 in this manner, the first pump port 41, second pump port 42, third pump port 43 and fourth pump port 44 can be concentrated on a circumferential direction centering on the rotary axis O, leading to a reduction in a rotary axis O direction of the port block 70 and a corresponding reduction in the size of the tandem piston pump 1.

In a conventional tandem piston pump, on the other hand, the tilt axis of the front swash plate and the tilt axis of the rear swash plate extend in the same direction, and therefore the rotation angle range of the shaft in which the front pump discharges working oil is in phase with the rotation angle range of the shaft in which the rear pump discharges working oil. Therefore, to reduce the passage length of the ports formed in the port block, the respective pump ports of the front pump and the respective pump ports of the rear pump must be provided in a single side face, and as a result, the rotary axis O direction dimension of the port block increases in accordance with the space required to open the respective pump ports, leading to a corresponding increase in the size of the apparatus.

In this embodiment, as described above, the tandem piston pump 1 from which pump discharge pressure from four systems is extracted comprises: the shaft 5 that rotates about the rotary axis O; the front pump 10 and rear pump 50 provided in series in a rotary axis O direction; and the port block 70 provided between the front pump 10 and the rear pump 50, wherein the front pump 10 includes: the front cylinder block 13 that is rotated by the shaft 5; the front swash plate 14 that causes the plurality of pistons 18 to reciprocate when the front cylinder block 13 rotates; the first discharge port 21 and second discharge port 22 through which working oil discharged by the respective pistons 18 passes; and the first pump port 41 and second pump port 42 that communicate with the first discharge port 21 and second discharge port 22 to extract pump discharge pressure therefrom, the rear pump 50 includes: the rear cylinder block 53 that is rotated by the shaft 5; the rear swash plate 54 that causes the plurality of pistons 58, 59 to reciprocate when the rear cylinder block 53 rotates; the third discharge port 23 and fourth discharge port 24 through which working oil discharged by the respective pistons 58, 59 passes; and the third pump port 43 and fourth pump port 44 that communicate with the third discharge port 23 and fourth discharge port 24 to extract pump discharge pressure therefrom, the first pump port 41 and second pump port 42 of the front pump 10 and the third pump port 43 and fourth pump port 44 of the rear pump 50 are respectively opened in the port block 70 such that a tilt axis direction of the front swash plate 14 and a tilt axis direction of the rear swash plate 54 are different to each other, the third discharge port 23 and fourth discharge port 24 of the rear pump 50 are opened at a phase difference relative to the first discharge port 21 and second discharge port 22 of the front pump 10, and the first pump port 41 and second pump port 42 of the front pump 10 and the third pump port 43 and fourth pump port 44 of the rear pump 50 are opened in the different side faces 71, 72 of the port block 70, respectively. Hence, a situation in which a plurality of pump ports are opened in concentrated fashion in a single side face can be avoided, leading to a reduction in the rotary axis O direction dimension of the port block 70 and a corresponding reduction in the size of the tandem piston pump 1.

In this embodiment, the tilt axis direction of the front swash plate 14 and the tilt axis direction of the rear swash plate 54 differ from each other by substantially 90°, and therefore the third discharge port 23 and fourth discharge port 24 of the rear pump 50 are disposed at a phase difference of substantially 90° on the rotary axis O relative to the first discharge port 21 and second discharge port 22 of the front pump 10. Thus, the third pump port 43 and fourth pump port 44 of the rear pump 50 can be concentrated relative to the first pump port 41 and second pump port 42 of the front pump 10 on a circumferential direction centering on the rotary axis O, leading to a reduction in the size of the port block 70.

In this embodiment, the port block 70 is formed with the mutually orthogonal side face 71 and side face 72, and the plurality of pump ports 41, 42 provided in the front pump 10 open onto one side face 71 while the plurality of pump ports 43, 44 provided in the rear pump 50 open onto the other side face 72. Therefore, a situation in which the pump ports are concentrated in a single side face can be avoided, and as a result, the size of the tandem piston pump 1 can be reduced.

It should be noted that the invention is not limited to this structure, and one of the first pump port 41 and second pump port 42 may open onto the side face 71 while the other opens onto the side face 73 or the side face 72.

Further, one of the third pump port 43 and fourth pump port 44 may open onto the side face 72 while the other opens onto the side face 73 or the side face 71.

INDUSTRIAL APPLICABILITY

As described above, the tandem piston pump according to this invention is useful as an oil pressure source installed in a construction machine such as a hydraulic shovel, but is not limited thereto, and may also be used as an oil pressure source provided in other machines, facilities, and so on.

The invention claimed is:

1. A tandem piston pump from which pump discharge pressure from a plurality of systems is extracted, comprising:

a shaft that rotates about a rotary axis;

a front pump and a rear pump provided in series in a rotary axis direction; and a port block provided between the front pump and the rear pump, the port block having a front face facing the front pump, a rear face facing the rear pump, and side faces connecting the front face and the rear face, wherein the front pump comprises:

a front cylinder block that is rotated by the shaft;

a plurality of front pistons accommodated in the front cylinder block, each of the front pistons comprising a front cylinder port through which working oil passes when the front piston reciprocates in the front cylinder block and the front cylinder ports of the plurality of the front pistons comprising a first front cylinder port and a second front cylinder port;

a front swash plate having a front tilt axis, the front swash plate being tiltable so as to tilt about the front tilt axis and cause the plurality of front pistons to reciprocate when the front cylinder block rotates;

a first front pump port that communicates with the first front cylinder port to extract pump discharge pressure therefrom; and a second front pump port that communicates with the second front cylinder port to extract pump discharge pressure therefrom, and wherein the rear pump comprises:

a rear cylinder block that is rotated by the shaft;

a plurality of rear pistons accommodated in the rear cylinder block, each of the rear pistons comprising a rear cylinder port through which working oil passes when the rear piston reciprocates in the rear cylinder block and the rear cylinder ports of the plurality of the rear pistons comprising a first rear cylinder port and a second rear cylinder port;

a rear swash plate having a rear tilt axis, the rear swash plate being tiltable so as to tilt about the rear tilt axis and cause a plurality of rear pistons to reciprocate when the rear cylinder block rotates;

a first rear pump port that communicates with the first rear cylinder port to extract pump discharge pressure therefrom; and a second rear pump port that communicates with the second rear cylinder port to extract pump discharge pressure therefrom, wherein the front tilt axis and the rear tilt axis are disposed orthogonal to the rotary axis while being directed differently from each other, the first rear cylinder port and the second rear cylinder port are opened at a phase difference relative to the first front cylinder port and the second front cylinder port, and the first front pump port and the second front pump port are opened in a side face of the port block while the first rear pump port and the second rear pump port are opened in a different side face of the port block, and the front tilt axis and the rear tilt axis are directed differently from each other by substantially 90°.

2. The tandem piston pump as defined in claim 1, wherein the side faces of the port block include two mutually orthogonal side faces, the first front pump port and the second front pump port are opened in one of the two mutually orthogonal side faces, and the first rear pump port and the second rear pump port are opened in the other of the two mutually orthogonal side faces.

* * * * *